US005586534A

United States Patent [19]

Fujimoto

[11] Patent Number: 5,586,534

[45] Date of Patent: Dec. 24, 1996

[54] SYSTEM FOR DETECTING FULLY CLOSED STATE OF THE THROTTLE VALVE FOR USE IN INTERNAL COMBUSTION ENGINE

[75] Inventor: Takanori Fujimoto, Tokyo, Japan

[73] Assignee: Mitsubishi Denki Kabushiki Kaisha, Tokyo, Japan

[21] Appl. No.: 581,210

[22] Filed: Dec. 29, 1995

[30] Foreign Application Priority Data

Aug. 15, 1995 [JP] Japan ..... 7-208074

[51] Int. Cl.[6] ..... F02D 41/12; F02D 41/16

[52] U.S. Cl. ..... 123/325; 123/339.23; 73/117.3

[58] Field of Search ..... 123/339.19, 339.21, 123/339.22, 339.23, 325, 326, 493, 494; 73/117.3, 118.1

[56] References Cited

U.S. PATENT DOCUMENTS 5,003,816 4/1991 Furuyama ..... 73/117.3

FOREIGN PATENT DOCUMENTS 61-171855 8/1986 Japan .

OTHER PUBLICATIONS

Patent Abstracts Of Japan, [M–1441], vol. 17, No. 362, p. 58, Jul. 8, 1993 & JP 5–52148, (Yamada), Mar. 2, 1993. Jul. 1993.

*Primary Examiner*—Andrew M. Dolinar

*Attorney, Agent, or Firm*—Sughrue, Mion, Zinn, Macpeak & Seas .

[57] ABSTRACT

A throttle valve full-closure detecting system for an internal combustion engine which is capable of surely detecting a fully closed state of a throttle valve and further of preventing the occurrence of troubles when an accelerator pedal is released from the state where the driver lightly places his foot thereon. The throttle valve full-closure detecting system comprises a full-closure detecting unit 6 for detecting the fully closed state of the throttle valve 1, and a throttle sensor 5 for sensing a throttle opening degree θ of the throttle valve 1. Further included in the system are a throttle full-closure detecting and storing unit 11 for averaging the throttle opening degrees to store it as a full-closure throttle opening degree o when the full-closure detecting unit 6 detects the fully closed state of the throttle valve 1 and a a throttle valve full-closure decision unit 12 for detecting that the throttle valve 1 is in the fully closed state when the full-closure detecting unit 6 detects the fully closed state of the throttle valve 1 and the throttle opening degree is below an opening degree obtained by adding a predetermined value to the full-closure throttle opening degree.

4 Claims, 5 Drawing Sheets

SYSTEM FOR DETECTING FULLY CLOSED STATE OF THE THROTTLE VALVE FOR USE IN INTERNAL COMBUSTION ENGINE

BACKGROUND OF THE INVENTION

1. Field of the Invention

The present invention relates to a system for detecting a fully closed state of a throttle valve which is available for idle speed control, fuel cut-off control and the like in internal combustion engines, and more particularly to a fully closed-throttle valve detecting system for internal combustion engines which can stably maintain the decision criteria for the full closure of a throttle valve even if the opening degree of the throttle valve varies at the vicinity of its fully closed position.

2. Description of the Related Art

In internal combustion engines, there have heretofore been employed a system of detecting a totally closed condition of a throttle valve taken in response to the release of an accelerator pedal in implementing idle speed feedback control and the like. In this instance, as a rule an idle switch is used as a means to detect the totally closed state of the throttle valve.

However, since there is a need for the idle switch to always come into an on-state when the throttle valve get into the totally closed condition, the idle switch is designed to turn on not only when the throttle valve takes the totally closed condition but also when being in a slightly open condition.

For this reason, in a case where, for example, the vehicle driver lightly places his foot on the accelerator pedal while the engine is in the idle operating condition, the idle switch does not turn into the off-state but maintaining its on-state (totally closed condition). At this time, the throttle valve takes a slightly open condition with the idle switch being not in the off state, and hence the intake air quantity to the engine sometimes increases so that the engine speed increases.

Accordingly, if such a full-closure detecting system is applied to a prior idle speed control, then the control is such that the idle condition (the full closure of the throttle valve) is decided from the turning-on state of the idle switch and the bypass air quantity is feedback-controlled so that the engine speed becomes equal to a target idle speed.

In this case, in the case that the vehicle driver lightly places his foot on the accelerator pedal as mentioned above, even in a state where the engine speed increases while the idle switch is in the turn-on condition, there results in continuous feedback control. Thus, in a case where the driver releases the accelerator pedal to allow the throttle valve to get into the fully closed condition after continuing to place his foot thereon, since the bypass air quantity already decreases at the time of the operation of the accelerator pedal, difficulty is encountered to keep the coincidence of the engine speed with the target idle speed at shifting to the full closure, with the result that there is a possibility that an engine stall arises or the idle speed exceedingly lowers.

FIG. 7 is a timing chart showing one example of a variation of an engine speed Re in relation to a variation of an opening degree (depressing amount of an accelerator pedal) of a throttle valve, and exemplifies the relationship among an idle signal AS (indicative of a state of an idle switch), the opening degree θ of the throttle valve, an bypass air quantity Qb, and the engine speed Re. In FIG. 7, Qbo denotes a basic air quantity for the bypass air quantity Qb at idle operation, and Reo depicts a target idle speed for the engine speed Re.

In this instance, there are shown a behavior (see time t2) taken in a case where the vehicle driver lightly places his foot on the accelerator pedal (time t0) when the idle signal AS is in the on-state and the accelerator pedal is released to allow the throttle valve to get into a fully closed state (θ=0) (time t1) after the driver continues to press the accelerator pedal as it is (throttle opening degree θ=θa), and a behavior (see time t4) arising in a case where the accelerator pedal is released to permit the throttle valve to come into a fully closed condition (θ=0) (time t3) after the accelerator pedal is on pressing to cause the idle signal AS to come into the off-state and to stop the idle condition (non-idling state: throttle opening degree θ=θb) and then returning to a state where the driver lightly places his foot thereon (lightly footed state) and being kept in that condition (throttle opening degree θ=θa).

As obvious from FIG. 7, when the idle signal AS takes its on-state (the throttle valve is substantially in the fully closed condition), the feedback control starts on the basis of the detection of the increase in the engine speed Re even if the throttle valve takes the throttle opening degree θa resulting from the driver lightly placing his foot on the accelerator pedal, thus controlling the bypass air quantity Qb. Thus, if the accelerator pedal shifts from the lightly footed state (throttle opening degree θ=θa) to the throttle valve full-closure side (θ=0) (see time t1), the engine speed Re rapidly decreases (see time t2).

Further, if the vehicle driver once presses the accelerator pedal to turn off the idle signal AS (throttle opening degree θ=θb) before returning it to the lightly footed state (throttle opening degree θ=θa), the feedback control for the bypass air quantity Qb begins to suppress the engine speed Re. Accordingly, if the accelerator pedal is subsequently returned to the throttle valve full-closure side (θ=0) (see time t3) , the engine speed Re rapidly decreases (see time t4). Even in this case, the troubles such as an engine stall sometimes take place.

For resolution of these disadvantages, there has been proposed a technique as disclosed in Japanese Patent Published No. 6-100129. However, this prior technique can not sufficiently cope with a problem that, when the vehicle driver releases the accelerator pedal, the engine stall arises or the idle speed lowers due to the lack of the bypass air quantity Qb immediately after that release of the accelerator pedal.

More specifically, according to the prior technique, the minimum value (coincident with the throttle opening degree at the full-closure of the throttle valve) of the throttle opening degree θ is detected through a throttle sensor so that, even if the idle signal AS is in the on-state, the feedback control stops on the decision that the accelerator pedal is in a lightly footed condition when the throttle opening degree θ exceeds the minimum value by a given value. In addition, for compensating for the variation of the throttle valve full-closure detecting system with the passage of time, the minimum value of the throttle opening degree θ is initialized in the non-idling condition and the minimum value is again detected at shifting to the idling condition.

Thus, although the prior technique can avoid the rapid decrease (see time t2 in FIG. 7) of the engine speed Re which arises when the accelerator pedal is released from the lightly footed state while the idle signal AS is in the on-state, it can not prevent the rapid decrease (see time t4) of the engine speed Re which arises when the accelerator pedal returns from the non-idling state (a large throttle opening degree θb) to the lightly footed state (a small throttle opening degree θa in the substantially full-closure state) and is kept in that condition and then the driver completely releases the accelerator pedal.

Moreover, the throttle valve full-closure detecting system noted above is also applicable to fuel supply control for cutting off the fuel when the throttle valve is in the fully closed condition (full-closure fuel cut-off). As a rule, the fuel supply control is for the purpose of cutting off the fuel with a view to improving the fuel consumption when the engine speed Re exceeds a predetermined speed for decision (the lower limit of the fuel cut-off area) and the throttle valve is in the fully closed state.

In the case that the throttle valve full-closure detecting system is used in the fuel supply control application, even if the fuel cut-off is made while the accelerator pedal is in the lightly footed state, there is a need for the fuel cut-off decision speed to be set high in order to avoid the occurrence of the hatching of the engine speed Re resulting from the return to the fuel cut-off state. Accordingly, in this instance, the fuel cut-off operating area becomes narrow, thus resulting in considerably counteracting the original full-closure fuel cut-off effects.

Since the prior throttle valve full-closure detecting system for an internal combustion engine is, as described above, designed such that the idle switch detects the fully closed state irrespective of the throttle valve being in a slightly open condition (θ=θa), in the case of being applied to the feedback control for the idle speed, the system provides a problem in that, owing to the shortage the air quantity, the engine stall takes place or the engine speed Re lowers at the time of the idling operation.

In addition, since the technique disclosed in the Japanese Patent Published No. 66-100129, for example, is such that the lightly footed state of the accelerator pedal is decided on the condition that the throttle opening degree θ after character becomes greater by a given value than the minimum throttle opening degree so as to inhibit the feedback control for the idle speed, the lowering of the engine speed Re similarly occurs when the driver frees the accelerator pedal from the footing after returning it from the non-idling state (θ=θb) exhibiting a large throttle opening degree θ to the lightly footed state (θ=θa) and then keep it in that condition.

Moreover, in the case that the system is applied to the fuel supply control to cut of fuel in an area where the engine speed is above a predetermined decision speed when the throttle valve is in the fully closed condition, the fuel cut-off operating region becomes narrow, for that the fuel cut-off decision speed is set to a high value in order to avoid the hatching of the engine speed Re, with the result that the original full-closure fuel cut-off effects deteriorate.

SUMMARY OF THE INVENTION

The present invention has been developed with a view to eliminating the aforesaid problems, and it is therefore an object of the present invention to a full-closure detecting system for a throttle valve of an internal combustion engine which is capable of surely detecting the fully closed condition of the throttle valve concurrent with preventing the occurrence of the disadvantages when the driver releases the accelerator pedal from the lightly footed condition.

In accordance with a preferred form of the invention, a system for detecting a fully closed state of a throttle valve for an internal combustion engine, comprises full-closure detecting means for detecting a fully closed state of-the throttle valve of the engine, a throttle sensor for sensing an opening degree of the throttle valve, throttle full-closure detecting and storing means for averaging the throttle opening degrees to store the average value as a full-closure throttle opening degree when the full-closure detecting means detects the fully closed state of the throttle valve, and throttle valve full-closure decision means for making a decision that the throttle valve is in the fully closed condition when the fully closed state of the throttle valve is detected and the throttle opening degree is below an opening degree threshold obtained by adding a predetermined opening degree to the full-closure throttle opening degree.

In accordance with another preferred form of the invention, in the throttle valve full-closure detecting system, the throttle full-closure detecting and storing means is arranged so that an average processing speed at the time of the throttle opening degree shifts in an opening direction is lower than an average processing speed at the time of the throttle opening degree shifts in a closing direction.

In accordance with a further preferred form of the invention, the throttle valve full-closure detecting system further comprises idle speed control means for adjusting an intake air quantity to the engine at an idle operation of the engine so as to feedback-control an engine speed to a given idle speed, and feedback control decision means for selectively making the idle speed control means effective, and the feedback control decision means includes throttle valve full-closure decision means and inhibits the feedback control by the idle speed control means when the throttle valve full-closure decision means does not decide in the full closure of the throttle valve.

In accordance with a still further preferred form of the invention, the throttle valve full-closure detecting system further comprises an engine speed sensor for sensing an engine speed of the engine and fuel supply quantity control means for controlling a fuel supply quantity to the engine in accordance with the engine speed, and the fuel supply quantity control means cuts off a fuel supply to the engine when the engine speed exceeds a predetermined value and the throttle valve full-closure decision means decides in the full closure of the throttle valve.

BRIEF DESCRIPTION OF THE DRAWINGS

The object and features of the present invention will become more readily apparent from the following detailed description of the preferred embodiments taken in conjunction with the accompanying drawings in which.

DESCRIPTION OF THE PREFERRED EMBODIMENTS

Embodiment 1

Figure 1:
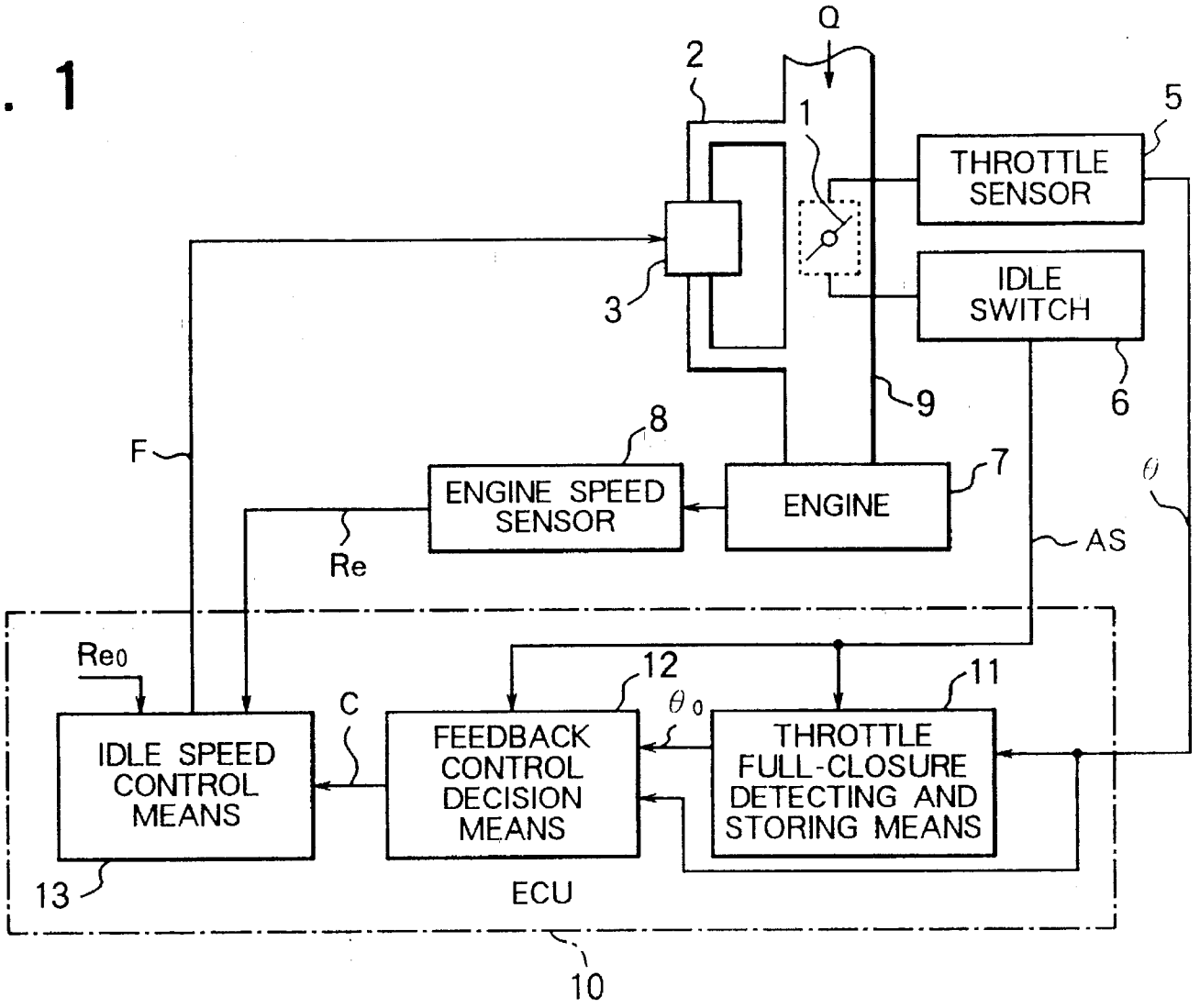
FIG. 1 is a block diagram schematically showing a functional arrangement of a throttle valve full-closure detecting system for an internal combustion engine according to an embodiment of the present invention.
Figure 2:
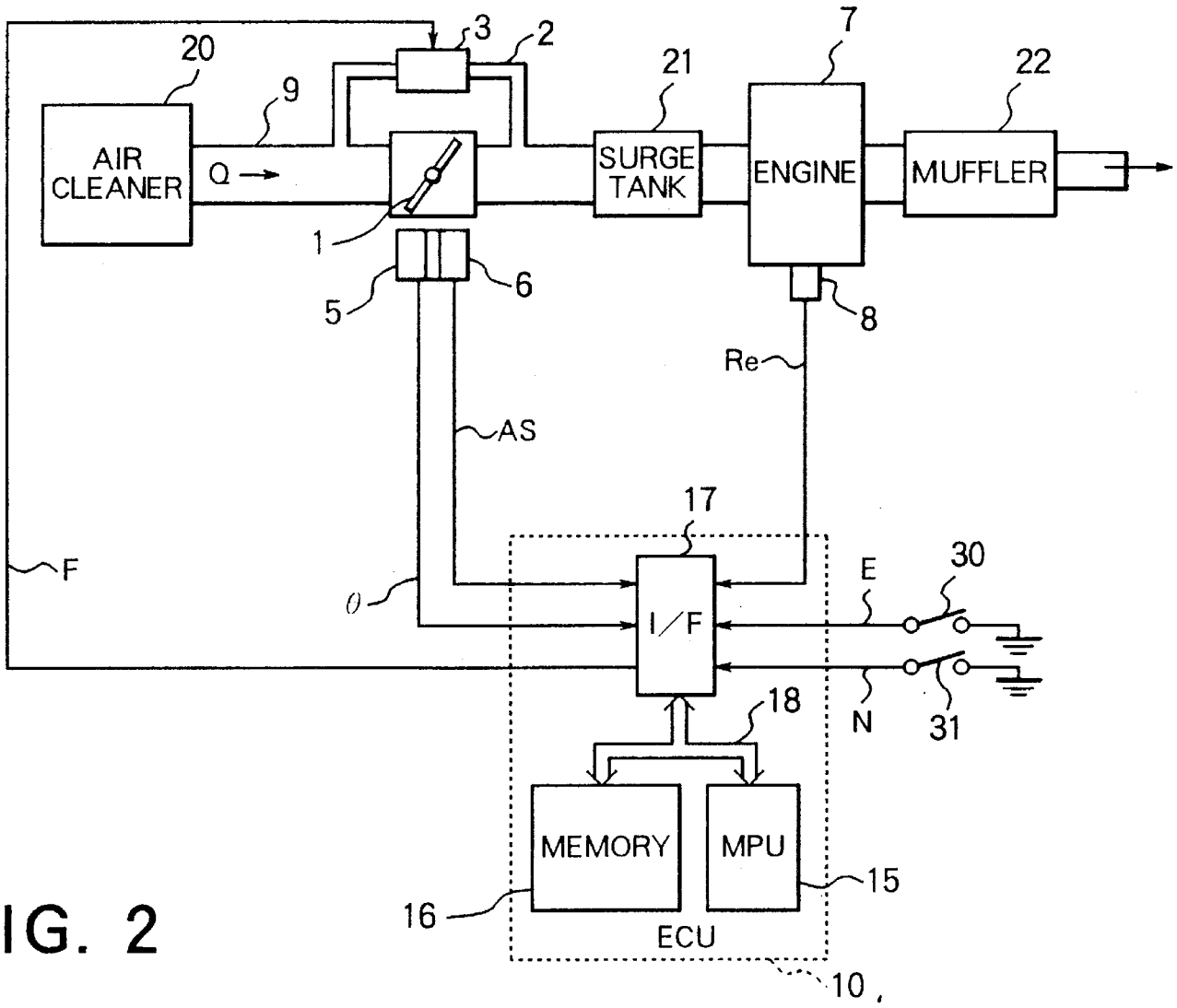
FIG. 2 is a block diagram schematically showing an arrangement of a principal section of the system according to this embodiment.

A description will be made hereinbelow of an embodiment of the present invention with reference to the drawings. FIGS. 1 and 2 are block diagrams schematically showing a basic arrangement of this embodiment, and of these, FIG. 1 mainly shows a functional arrangement within an ECU (electronic control unit), while FIG. 2 illustrates components around an engine and components within the ECU. In the illustrations, an idle signal AS, an engine speed Re, a target idle speed Reo, and a throttle opening degree θ are similar to those in the above description.

In an intake pipe 9 for supply of intake air Q into an engine 7, there is set a throttle valve 1 which adjusts the air quantity in connection with an accelerator pedal, not shown. A bypass passage 2 is placed to establish a communication between an upstream side and downstream side of the throttle valve 1. Further, placed in this bypass passage 2 is a bypass air quantity adjusting means 3, i.e., an idle speed control valve (which will be referred to as an ISC valve), which adjusts the intake air amount at idling operation.

The ISC valve 3 is designed to adjust the opening area of the bypass passage 2 to control the engine speed Re at the idling operation. As a general ISC valve 3 is well known a step motor type ISC valve.

The throttle valve 1 is equipped with a throttle sensor 5 for sensing the throttle opening degree θ and an idle switch (full-closure detecting means) 6 for detecting the fact that the throttle valve 1 reaches the fully closed condition (or substantially full closure) to output the idle signal AS. The idle switch 6 is constructed integrally with the throttle sensor 5.

In addition, the engine 7 is provided with an engine speed sensor 8 for detecting the engine speed Re. The engine speed sensor 8 is composed of a crank angle sensor which generates a pulse (corresponding to the engine speed Re) whenever the engine 7 rotates by a predetermined angle.

In FIG. 1, an ECU 10 constructed with a microcomputer includes a throttle full-closure detecting and storing means 11 for detecting and storing a full-closure throttle opening degree θo of the throttle valve 1 on the basis of a throttle opening degree θat the time of the idle signal AS being in the on-state, a feedback control decision means 12 for determining the presence or absence of the feedback control for the idle speed on the basis of the full-closure throttle opening degree θo and the throttle opening degree θat the turning-on of the idle signal AS, an idle speed control means 13 for feedback-controlling the ISC valve 3 in response to a decision result C of the feedback control decision means 12, and a target speed setting means (not shown) for outputting a predetermined target idle speed Reo at the idle operation.

The throttle full-closure detecting means 11 averages the throttle opening degrees θ to obtain the full-closure throttle opening degree θo when the idle switch 6 detects a fully closed state of the throttle valve 1 and the idle signal AS turns into the on-state and stores the averaged result. Further, the feedback control decision means 12 includes a throttle valve full-closure decision means which decides whether or not the throttle valve 1 is in the fully closed condition and then outputs the decision result C when the full-closure of the throttle valve 1 is detected and the throttle opening degree θ is below an opening degree threshold (θo+Δθ) obtained by addition of a given opening degree Δθ to the full-closure throttle opening degree θo.

Furthermore, the idle speed control means 13 outputs an idle control signal F to the ISC valve 3 in response to the decision result C (feedback control permission instruction) representative of the idling state when the throttle valve 1 comes into the fully closed state (or substantially full closure) and the idle switch 6 is in the on-state.

With this: arrangement, the ISC valve 3 is operated in accordance with the difference (Re–Reo) between the engine speed Re from the engine speed sensor 8 and the target idle speed Reo and the feedback control is implemented so that the engine speed Re becomes equal to the target idle speed Reo.

Furthermore, in FIG. 2, the intake pipe 9 is equipped with an air cleaner 20 disposed in an incoming side of the intake air Q, a surge tank 21 placed in an upstream side of the engine 7, and a muffler 22 located in a discharge side of the exhaust gas. The intake air Q is introduced from the air cleaner 20 through the throttle valve 1 and the bypass passage 2 into the surge tank 21 and then mixed with fuel from a fuel supply means (not shown) and led into the engine 7. Thus, the fuel mixed with the intake air Q is combusted in cylinders (not shown) of the engine 7. The exhaust gas generated by the combustion is discharged through the muffler 22 to the atmosphere.

In addition to the aforesaid sensors 5 to 7, coupled to the ECU 10 are various sensors, for example, an air conditioning switch 30 which comes into the on-state at air conditioning operation to output an air conditioning signal E and a neutral switch 31 which assumes the on-condition to output a neutral signal N when the shift for the engine 7 takes the neutral position.

The ECU 10 comprises an MPU 15 fulfilling the function of the microcomputer body, i.e., serving as the aforementioned means 11 to 13, memories 16 such as a ROM and a RAM belonging to the MPU 15, an interface circuit 17 operative to receive the various sensor signals AS, E, N, Re and θand further to output an idle control signal F, and a common bus 18 for making communications between the memories 16 and interface circuit 17, and the MPU 15.

The MPU 15 receives, through the interface circuit 17, the idle signal AS indicative of the fully closed state of the throttle valve 1, the throttle opening degree θ being a voltage signal proportional to the opening degree of the throttle valve 1, and the engine speed Re being pulses each produced at an interval of a given rotation. On the other hand, the MPU 15 has a #unction to calculate a controlled variable (equivalent to the idle control signal F) of the engine speed on the basis of these input signals.

Figure 3:
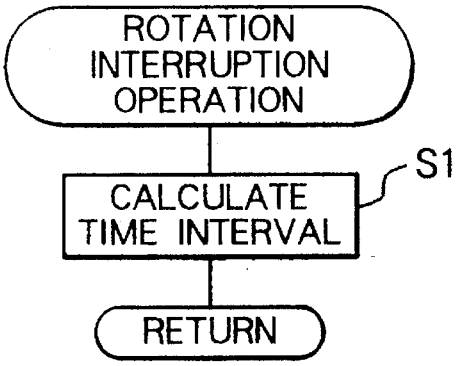
FIG. 3 is a flow chart illustrating a rotation interruption operation for idle speed control in the system according to this embodiment.
Figure 4:
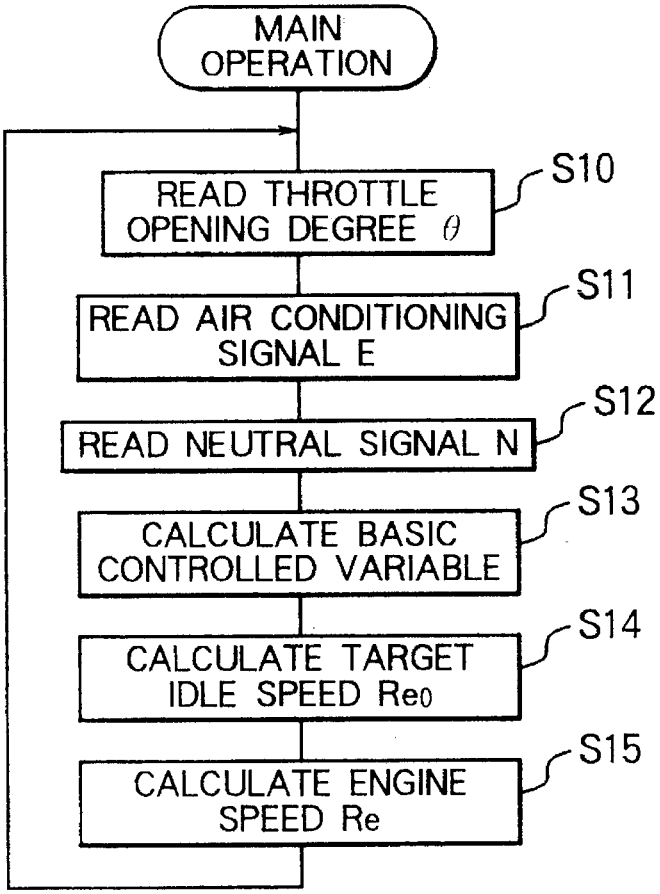
FIG. 4 a flow chart illustrating a main process for the idle speed control in the system according to this embodiment.

Secondly, referring to FIGS. 3 and 4, a schematic description will be made hereinbelow of the idle control in the embodiment of this invention shown in FIGS. 1 and 2. FIGS. 3 and 4 are flow charts showing the idle control operation to be executed in the ECU 10, and FIG. 3 illustrates a rotation interruption operation to be implemented at an interval of a given rotational angle (whenever the generation of each pulse) sensed with the engine speed sensor (crank angle sensor) 8 and FIG. 4 illustrates the main operation.

In the FIG. 3 rotation interruption operation, a step S1 is executed in order to calculate the difference between the present interruption time and the previous interruption time, i.e., the time interval between the pulses produced at every given rotational angle. This time interval corresponds to the engine speed Re.

Furthermore, the FIG. 4 main operation includes a step S10 to A/D-convert the throttle opening degree θ from the throttle sensor 5 in the interface circuit 17 and to read the A/D-converted throttle opening degree, a step S11 to read the air conditioning signal E (indicative of a state of the air conditioning switch 30) through the interface circuit 17, and a step S12 to read the neutral signal N (representative of a state of the neutral switch 31) through the interface circuit 17.

Also included in the main operation are a step S13 to obtain a basic controlled variable (corresponding to the basic idle control signal F) on the basis of the states of the air conditioning switch 30 and the neutral switch 31 read in the previous steps S11 and S12 and a step S14 to obtain a target idle speed Reo during the idle speed control. Subsequently, a step S15 is implemented to calculate the engine speed Re on the basis of the time interval calculated in the FIG. 3 rotation interruption process. After the completion of this operation, the operational flow again returns to the step S10.

The reason the basic controlled variable for the ISC valve 3 was obtained in accordance with the the states of the air conditioning switch 30 and the neutral switch 37 in the step S13 is that the load to the engine 7 depends upon the states of the switches 30, 31 and the intake air quantity at the idle operation also comes under the influence of these states. In addition, the reason the target idle speed Reo was obtained at the time of the idle speed control in the step S14 is that the target idle speed Reo should be raised to enhance the air conditioning effects, for example, when the air conditioning switch 30 is in the on-state.

Figure 5:
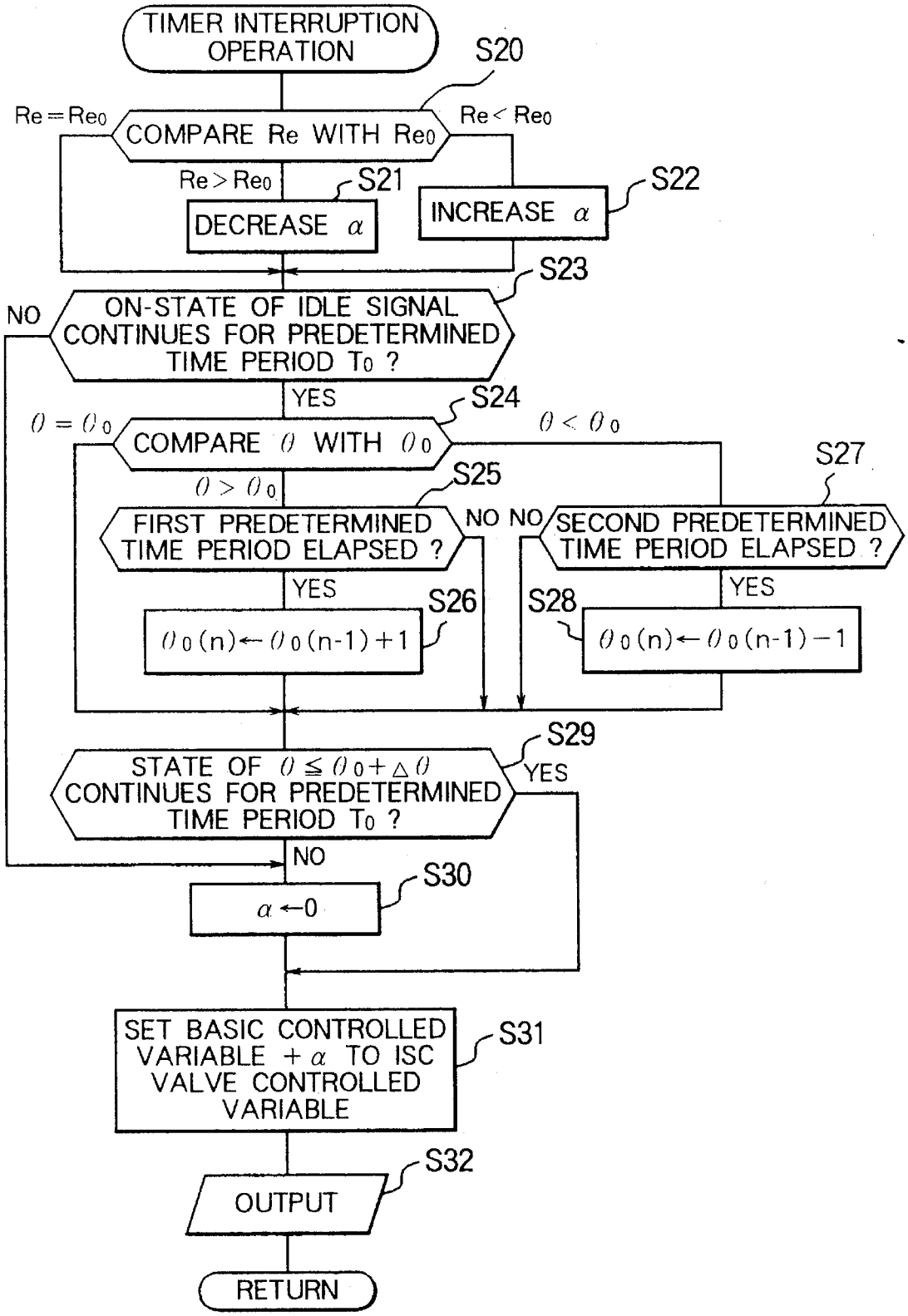
FIG. 5 is a flow chart illustrating an timer interruption operation for idle speed control in the system according to this embodiment.

Moreover, a detailed description will be made with reference to the flow chart of FIG. 5 in terms of the idle control in the embodiment of this invention shown in FIGS. 1 and 2. FIG. 5 is an illustration of a timer interruption operation to be implemented at a given time interval (for instance, 1 second). In FIG. 5, this operation begins with a step S20 to compare the engine speed Re obtained in the step S15 of the FIG. 4 main operation with the target idle speed Reo obtained in the step S14 in the same main operation.

If a decision is made to that the engine speed Re is greater than the target idle speed Reo (Re>Reo), a step S21 follows to decrease the feedback controlled variable in the idle speed control, then advancing to a step S23. On the other hand, if otherwise in the step S20, i.e., if a decision is that the engine speed Re is smaller than the target idle speed Reo (Re<Reo), a step S22 follows to increase the feedback controlled variable a then proceeding to the step S23.

Moreover, if the engine speed Re is equal to the target idle speed Reo (Re=Reo), the operational flow jumps the step S21 or S22 to the step S23 where a check is made as to whether or not the idle signal AS continues the on-state for a given time To (or example, approximately 2 seconds).

If the idle signal AS is in the off-state or does not continuously take the on-state for the time period To (that is, the answer is NO), the operational flow goes to a feedback control inhibition step 30 which will be described later. Going the other way, if the decision shows the continuation of the on-state of the idle signal AS for the time period To (that is, the answer is YES), a step S24 is subsequently executed to compare the throttle opening degree detected with the throttle sensor 5 with the full-closure throttle opening degree θo stored in the throttle full-closure detecting and storing means If the comparison result shows that the throttle opening degree θ is greater than the full-closure throttle opening degree θo (when θ>θo), then a step S25 follows to check to see if a first predetermined time period elapses or not. When the decision of the step S25 indicates the elapse of the first predetermined time period (that is, the answer is YES), a step S26 is implemented to increment the previous full-closure throttle opening degree θo(n−1) and to use (update) it as the present full-closure throttle opening degree θo (n). Thereafter, the operational flow advances to a step S29.

Returning the description to the step 24, if the decision comes to that the throttle opening degree θ is below the full-closure throttle opening degree θo (when θ<θo), then a step S27 is executed to check whether a second predetermined time period elapses or not. If the decision indicates the elapse of the second predetermined time period (that is, the answer is YES), a step S28 follows to decrement the previous full-closure throttle opening degree θo(n−1) and to use (update) it as the present full-closure throttle opening degree θo(n), subsequently proceeding to the step S29.

Accordingly, the full-closure throttle opening degree θo increases at every elapse of the first predetermined time period through the steps S25 and S26, while decreasing at every elapse of the second predetermined time period through the steps S27 and S28. In the steps S26 and S28 for increasing and decreasing the full-closure throttle opening degree θo, θo(n) and θo(n−1) represent the stored values at the time of the present and previous increasing and decreasing updating, respectively.

Further, the first predetermined time period (>the second predetermined time period) is ordinarily set to a time period longer than the time for which the driver will lightly places his foot on the accelerator pedal and keeps it in that condition. In addition, the second predetermined time period (<the first predetermined time period) is set to a time (for example, approximately 2 seconds) which can inhibit that the full-closure throttle opening degree θo decreases several times even if the throttle sensor 5 is instantaneously grounded in error.

In this operation, the reason the first predetermined time period is set to be longer than the second predetermined time period is that the update (averaging processing speed) to the minimum value of the full-closure throttle opening degree θo due to the averaging process of the throttle opening degree θ is speeded up, so that erroneous update of the full-closure throttle opening degree θo in the increasing direction is ordinarily avoidable in such a degree that the driver lightly places his foot on the accelerator pedal and keeps it in that condition.

On the other hand, if the answer of the step S24 is that the throttle opening degree θ is equal to the full-closure throttle opening degree θo (θ=θo), the operational flow passes the steps S25 to S28 for increasing and decreasing the full-closure throttle opening degree θo and directly advances to the step S29.

The step S29 is executed in order to compare the present throttle opening degree θ with an opening degree threshold (θo+Δθ) being an addition result of a given opening degree Δθ (for example, approximately 0.3 degrees) to the full-closure opening degree θo updated and stored in the aforesaid increasing and decreasing steps S25 to S28, and further to check to see if the condition that the throttle opening degree θ is below the opening degree threshold (θo+Δθ) continues for a predetermined time period To (for example, 2 seconds). In this step, the predetermined time period To is set to be equal to the predetermined time period To in the step S20, while it is also possible to arbitrarily set them to different times.

If $\theta > \theta o + \Delta\theta$ or if the condition of $\theta \leqq \theta o + \Delta\theta$ does not continue for the predetermined time period To (that is, NO), a decision is that the driver is lightly placing his foot on the accelerator pedal and hence a step S30 is implemented to set the feedback controlled variable $\alpha$ to zero. Thus, the feedback control decision means 12 does not output the decision result C representative of the permission of the feedback control, thus inhibiting the feedback control by the idle speed control means 13.

Similarly, when the answer of the decision step S23 is NO, the operational flow goes to the feedback control inhibition step S30 to inhibit the idle speed feedback control. On the other hand, if the decision of the step S29 indicates that the condition of $\theta \leqq \theta o + \Delta\theta$ continues for the predetermined time period To (that is, YES), the operational flow passes the feedback control inhibition step S30 and advances to a step S31.

In this step S31, the final controlled variable for the ISC valve 3 is calculated as a function of the sum of the basic controlled variable obtained in the step S13 and the feedback controlled variable $\alpha$. At the end, in a step S32 the final controlled variable for the ISC valve 3 is outputted as the idle control signal F.

Figure 6:
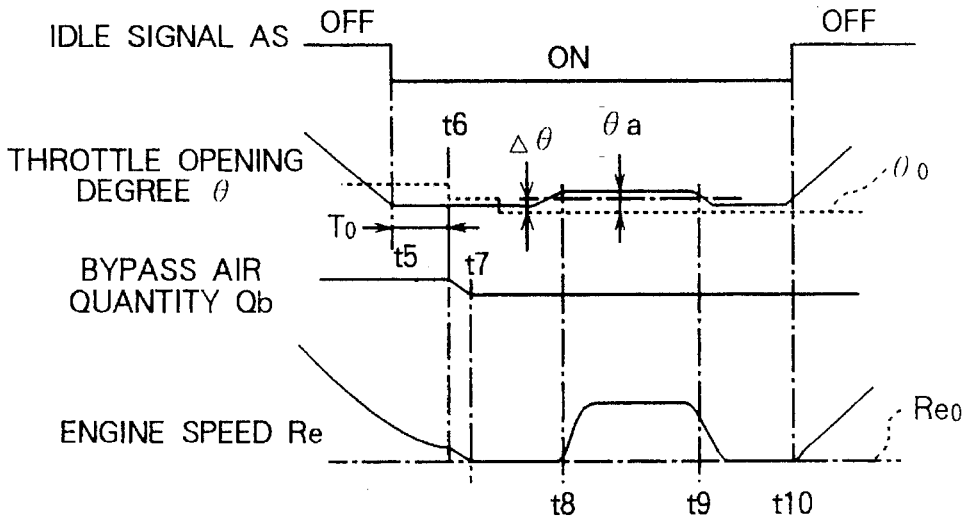
FIG. 6 is a timing chart showing a variation of an engine speed with respect to a variation of a throttle opening degree at the idle speed control in the system according this embodiment.
Figure 7:
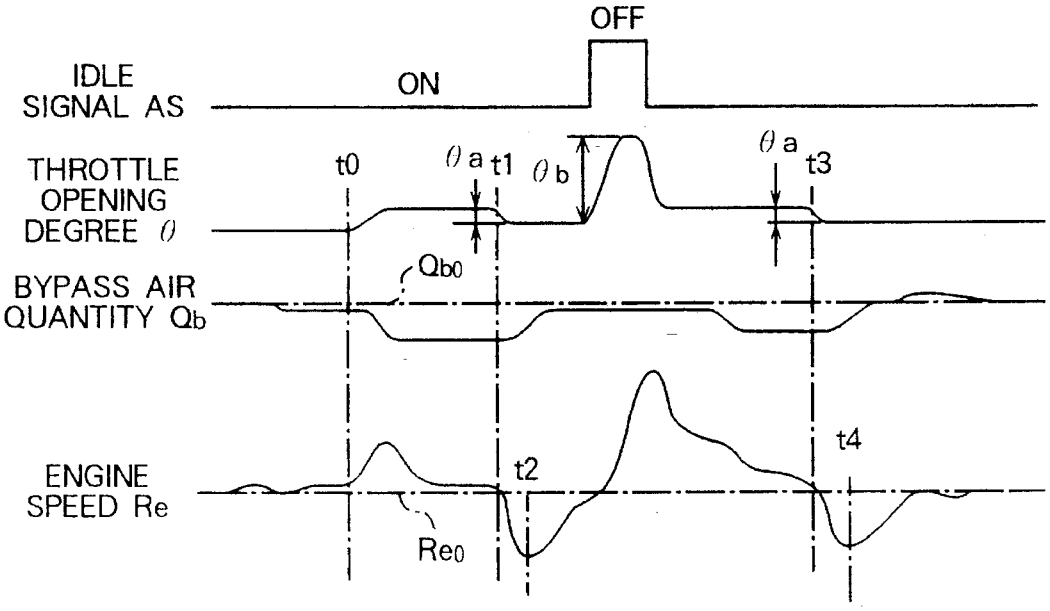
FIG. 7 PRIOR ART
FIG. 7 is a timing chart showing a variation of an engine speed with respect to a variation of a throttle opening degree at the idle speed control in a conventional throttle valve full-closure detecting system for an internal combustion engine.

FIG. 6 is a timing chart showing the operational relationship among the throttle opening degree $\theta$, the bypass air quantity Qb and the engine speed Re, and more specifically shows the behaviors of the idle signal AS, the throttle opening degree $\theta$, the full-closure throttle opening degree $\theta o$ (the value stored at the throttle full-closure), the bypass air quantity Qb and the engine speed Re which are taken while the idle signal AS varies from the off-state (the non-idling state due to the pressing of the accelerator pedal) to the on-state (the idling state due to the release of the accelerator pedal) (time t5) and then turns into the non-idling state (time t10).

In this illustration, the full-closure throttle opening degree $\theta o$ (dotted line) is shown as starting with t he initial state in which it does not still take a sufficiently decreasing-updated condition. In FIG. 6, in a case where the accelerator pedal is released (returned) so that the throttle opening degree $\theta$ decreases and the idle signal AS turns into the on-state (see time t5), if the throttle opening degree $\theta$ exhibits values above the opening degree threshold ($\theta o + \Delta\theta$) for the predetermined time period To (see time t6), the feedback control decision means 12 outputs the decision result C (permission instruction), whereby the idle speed feedback control starts.

In this instance, since the predetermined time periods in the decision steps S20 and S29 are the same and the decision is made as $\theta \leqq \theta o + \Delta\theta$ simultaneously with the turning-on of the idle signal AS, the feedback control for the ISC valve 3 starts after the elapse of the predetermined time period To. On the other hand, if the predetermined time periods in the decision steps S20 and S29 are different from each other, the feedback control for the ISC valve 3 begins after the elapse of the longer one of the predetermined time periods.

That is, as well as the above description, the bypass air quantity Qb is suppressed so that Re=Reo. Thereafter, when the engine speed Re reaches the target idle speed Reo (see time t7), the bypass air quantity Qb becomes constant and the engine speed Re also become constant when arriving at the target idle speed Reo. Over this time period, the throttle opening degree detecting and storing means 11decreases the full-closure throttle opening degree $\theta o$ so as to perform the updating and storing of the full-closure throttle opening degree $\theta o$ which in turn come to a minimum value.

Subsequently, if the driver lightly places his foot on the accelerator pedal while the idle signal AS is in the on-state (see time t8), the throttle opening degree $\theta$ (=$\Delta a$) exceeds the opening degree threshold ($\theta o + \Delta\theta$), with the result that the feedback control decision means decides that the throttle valve 1 is not in the fully closed state but the driver lightly places his foot on the accelerator pedal, thus not outputting the decision result C (feedback permission instruction).

Accordingly, the idle speed feedback control stops after the time t8, and the bypass air quantity Qb maintains a constant state, while the engine speed Re increases in accordance with the throttle opening degree $\theta$.

Thereafter, if the accelerator pedal is released from the lightly footed state to come back to its original position (see time t9), the throttle opening degree $\theta$ decreases toward zero and, hence, the engine speed Re also decreases accordingly. At this time, the idle speed feedback control does not start until the predetermined time period To elapses, and the bypass air quantity Qb is maintained to be a constant value. For this reason, the engine speed Re quickly converges to the target idle speed Reo without decreasing below the controlled variable (target idle speed Reo) before the lightly footed condition as long as a slippage or shifting does not particularly occur during the lightly footed condition.

After the time t9, the throttle opening degree $\theta$ becomes below the opening degree threshold ($\theta o + \Delta\theta$), and hence the idle speed feedback control begins after the elapse of the predetermined time period To, whereas, if the engine speed Re does not particularly slip, the bypass air quantity Qb maintains a constant value as illustrated. On the other hand, if the engine speed Re is subjected to a slippage, the con,.rolled variable for the ISC valve 3 is changed and the engine speed Re is quickly controlled to the target idle speed Reo.

Then, if the accelerator pedal is operated to cause the idle signal AS to get into the off-state (see time t10), the engine 7 comes back to the normal operating condition and the engine speed Re takes a value corresponding to the throttle opening degree $\theta$.

Embodiment 2

A description will be made hereinbelow of another embodiment of this invention. Although in the first-mentioned embodiment the throttle valve full-closure detecting system for an internal combustion engine according to this invention is applied to the idle speed control, in this embodiment the concept of this invention is applied to the full-closure decision condition for the full-closure fuel cut-off in the fuel supply control which is implemented in order to improve the exhaust gas or the fuel consumption.

In this case, for the fuel supply control, the ECU 10 includes a fuel supply quantity control means for controlling the fuel supply quantity to the engine 7 in accordance with the engine speed Re. The fuel supply quantity control means of the ECU 10 is made to cut off the fuel supply to the engine 7 when the engine speed Re is above a predetermined value and the throttle valve full-closure decision means of the feedback control decision means 12 decides that the throttle valve 1is in the fully closed condition.

In consequence, it is possible to achieve the fuel cut-off in response to a high-reliable full-closure decision result not depending upon the lightly footed state, and to set the full-closure fuel cut-off decision speed (the lower limit in the fuel cut-off region) to a low value. Accordingly, the fuel cut-off operating area can enlarge.

Moreover, although in the first-mentioned embodiment the idle switch 6 is provided as the full-closure detecting means for detecting that the throttle valve 1 is in the fully closed state (or substantially full closure), a detecting means (not shown) can also be provided for deciding that the throttle opening degree $\theta$ is below a given opening degree.

As described above, according to this invention, the system comprises the throttle full-closure detecting and storing means 11and the feedback control decision means 12 including the throttle valve full-closure decision means, and the throttle full-closure detecting and storing means 11 stores as the full-closure throttle opening degree θo the averaged value of the throttle opening degrees θ detected with the throttle sensor 5 when the full-closure detecting means detects the fully closed state of the throttle valve of the engine 7, whereas the throttle full-closure decision means 12 decides that the throttle valve 1is in the fully closed state when the fully closed state of the throttle valve 1 is detected and the throttle opening degree θ is below the opening degree threshold (full-closure throttle opening degree θo+the predetermined opening degree Δθ).

This arrangement can offer the following effects. That is, if the full-closure decision means for the throttle valve of an internal combustion engine according to this invention is applied to the idle speed control, when the throttle valve 1 is slightly open (above the full-closure threshold) because the accelerator pedal is in the lightly footed state even if the idle signal AS assumes the on-condition (see the throttle opening degree θc in FIG. 6), the system does not make a decision on the full-closure, and can inhibit the idle speed feedback control irrespective of the increase in the engine speed Re.

Accordingly, because of no restriction of the bypass air quantity Qb, in a case where the accelerator pedal is released from the lightly footed state afterwards so that the throttle opening degree θ comes to the full-closure value, it is possible to prevent the engine stall or the lowering of the idle speed due to the lack of the air quantity.

Furthermore, if the full-closure decision means for the throttle valve 1 of an internal combustion engine according to this invention is applied to the fuel supply control, since the decision on the full-closure of the throttle valve 1can be made accurately and the fuel cut-off can be effected in accordance with the full-closure decision result, it is possible to set the speed for the full-closure fuel cut-off decision for the improvement of the exhaust gas and the fuel consumption to a low value. Accordingly, the fuel cut-off operating area can enlarge and the full-closure fuel cut-off effect, can improve.

Although the fully closed position of the throttle valve 1 will vary at every motor vehicle and will shift with the passage of time, according to this invention, the throttle full-closure detecting and storing means automatically updates the stored value of the full-closure throttle opening degree θo with the averaging process, and hence, regardless of instantaneously grounded accidents or the like, the detection and storage of the precise full-closure throttle opening degree θo are always possible without erroneous detection thereof.

Still further, according to this invention, in the throttle full-closure detecting and storing means 11, in terms of the averaging processing speed for the throttle opening degree θ, the speed for when the throttle opening degree θ shifts in the opening direction is set to be lower than the speed for when it shifts in the closing direction. Therefore, the update of the full-closure throttle opening degree θo to a minimum value can be speeded up and the erroneous update in the increasing direction can be suppressed in the case of the lightly footed condition of the accelerator pedal which the driver commonly performs, with the result that it is possible to surely avoid the erroneous full-closure decision at the time of the accelerator pedal being in the lightly footed state.

It should be understood that the foregoing relates to only preferred embodiments of the present invention, and that it is intended to cover all changes and modifications of the embodiments of the invention herein used for the purposes of the disclosure, which do not constitute departures from the spirit and scope of the invention.

What is claimed is:

1. A system for detecting a fully closed state of a throttle valve for an internal combustion engine, comprising:

full-closure detecting means for detecting a fully closed state of said throttle valve of said engine;

a throttle sensor for sensing an opening degree of said throttle valve;

throttle full-closure detecting and storing means for averaging the sensed throttle opening degrees to store the averaged value as a full-closure throttle opening degree when said full-closure detecting means detects the fully closed state of said throttle valve; and throttle valve full-closure decision means for making a decision that said throttle valve is in the fully closed condition when the fully closed state of said throttle valve is detected by said full-closure detecting means and the sensed throttle opening degree is below an opening degree threshold obtained by adding a predetermined opening degree to said full-closure throttle opening degree.

2. A system as defined in claim 1, wherein said throttle full-closure detecting and storing means is arranged so that an averaging speed for when said throttle opening degree shifts in an opening direction is lower than an averaging speed for when said throttle opening degree shifts to a closing direction.

3. A system as defined in claim 1, further comprising:

idle speed control means for adjusting an intake air quantity to said engine at an idle operation of said engine so as to feedback-control an engine speed to a given idle speed; and feedback control decision means for selectively making said idle speed control means effective, wherein said feedback control decision means includes throttle valve full-closure decision means and inhibits the feedback control by said idle speed control means when said throttle valve full-closure decision means does not decide that said throttle valve is in the fully closed state.

4. A system as defined in claim 1, further comprising:

an engine speed sensor for sensing an engine speed of said engine; and fuel supply quantity control means for controlling a fuel supply quantity to said engine in accordance with the sensed engine speed, wherein said fuel supply quantity control means cuts off a fuel supply to said engine when said engine speed exceeds a predetermined value and said throttle valve full-closure decision means decides that said throttle valve is in the fully closed state.

* * * * *